United States Patent [19]

Klitsner

[11] Patent Number: 4,874,342

[45] Date of Patent: Oct. 17, 1989

[54] JUMP CHUTE MARBLE RACE TOY

[75] Inventor: Daniel B. Klitsner, San Francisco, Calif.

[73] Assignee: Discovery Toys, Inc., San Francisco, Calif.

[21] Appl. No.: 214,239

[22] Filed: Jul. 1, 1988

[51] Int. Cl.[4] ..... A63H 29/08

[52] U.S. Cl. ..... 446/168; 273/86 C

[58] Field of Search ..... 446/168, 170; 273/86 C; 821/143, 59, 19

[56] References Cited

U.S. PATENT DOCUMENTS

| | | | |
|---|---|---|---|
| 2,752,727 | 7/1956 | Cotton | 446/168 |
| 2,838,870 | 6/1958 | Morse | 446/168 |
| 3,445,114 | 5/1969 | Fernandez | 446/168 X |
| 3,502,332 | 3/1970 | Wolf | 446/168 X |
| 3,818,628 | 6/1974 | Ensmann et al. | 446/168 X |
| 3,946,516 | 3/1976 | Wirth | 446/168 |
| 4,348,028 | 9/1982 | Barlow | 446/168 X |
| 4,713,038 | 12/1987 | Wichman et al. | 446/168 |
| 4,795,394 | 1/1989 | Thompson | 446/168 |

OTHER PUBLICATIONS

Discovery Toys Summer Catalog, 1987–berotoys catalog (two pages).

*Primary Examiner*—Mickey Yu

*Attorney, Agent, or Firm*—Townsend and Townsend

[57] ABSTRACT

A marble race toy (4) for use with a marble race game (2) of the type in which a marble (6) moves along a tortuous path. The toy alters the path of the marbles rolling through the game and includes a chute (10) and a landing (12) spaced from the chute. The chute includes an entrance (16) at the top of a downwardly extending speed track (14) and a jump (18), defined by an upturned end (20) at the lower end of the speed track. The landing is spaced from the jump and includes an exit (24) for the marble's traverse through the remaining toys of the marble race game.

8 Claims, 3 Drawing Sheets

JUMP CHUTE MARBLE RACE TOY

BACKGROUND OF THE INVENTION

Marble race games, in which a marble rolls along a tortuous path, have been developed and are enjoyable to watch. Modular constructions allow the user to construct different configurations. Children and adults alike are amused as their eyes follow the marble along the tortuous path which they have constructed.

Marble race games using ramps and tubular connectors are well-known. For example, U.S. Pat. No. 3,946,516 to Wirth discloses a game including only two distinct elements: a connecting tube and a track. The marble drops down the middle of the connecting tube to transfer its movement from one path to another from the top of the course to its bottom. Similarly, U.S. Pat. No. 2,838,870 to Morse discloses identical runways for interengagement of an extended course. The marble travels from the top of the course from one ramp to another until it reaches the bottom.

U.S. Pat. No. 4,713,038 to Wichman et al has been developed by the assignee of the present application and is incorporated by reference. Wichman et al discloses a variety of marble race toys having different configurations for altering the characteristics of travel as the marble passes through each toy, varying the rolling speeds and lengthening the time it takes for each marble to course through the game. Wichman et al includes a number of modular race toys constructed for connection to one another so that a marble passes from the exit of one marble race toy to the entrance of another, downstream marble race toy. All the marble race toys keep the marble moving at a great enough rolling speed to maintain visual interest and yet increase the amount of time it takes to course the entire route of the game. This is done in many of the individual toys of the Wichman et al patent by extending the path along which the marble rolls, or otherwise increasing the time it takes to traverse an entire marble race toy.

Other marble race toys have been created by the present inventor, including those described in applications entitled "State Gate Marble Race Toy," U.S. patent application Ser. No. 214,279, and "Banked Hairpin Marble Race Toy," U.S. patent application Ser. No. 214,243 each filed concurrently herewith and assigned to the assignee of the present invention, the disclosures of which are herewith incorporated by reference.

SUMMARY OF THE INVENTION

The present invention is directed to a marble race toy including, in order, a marble entrance, a chute, a landing spaced apart from the chute, and an exit. The chute is preferably J-shaped with a steeply sloping speed track and a jump, the jump being defined by an upturned lower end of the chute. The marble enters the toy through the entrance, travels downwardly along the speed track, past the upturned end, through the air and lands at the landing. The landing directs the marble into the exit and, thus, to the remaining toys of the marble race game.

The landing preferably includes a generally horizontal landing surface sloping downwardly toward the exit. A curved back stop extends upwardly from the landing surface and directs the marble towards the exit.

The marble race toy includes a modular construction for connection to different marble race toys so that a marble passes from the exit of one marble race toy to the entrance of another, downstream toy. The marble increases its speed as it travels down the chute, through the air and onto the landing, maintaining visual interest as the player watches the marble traverse the path of the marble race game. The marble race toy of the present invention provides an interesting course for the marbles, quickly increasing the speed of the marble as it drops down the chute and hurdles the space between the chute and the landing, after which it travels through the exit so as to follow the tortuous path of the remaining toys of the marble race game.

The marble race toy is preferably connected intermediate the start and finish of the marble race game; however, it is within the scope of the present invention to provide the marble race toy as a starting or finishing toy of the marble race game.

Other features and advantages of the invention will appear from the following description in which the preferred embodiment has been set for this detail in conjunction with the accompanying drawings.

DETAILED DESCRIPTION OF THE PREFERRED EMBODIMENT

Figure 1:
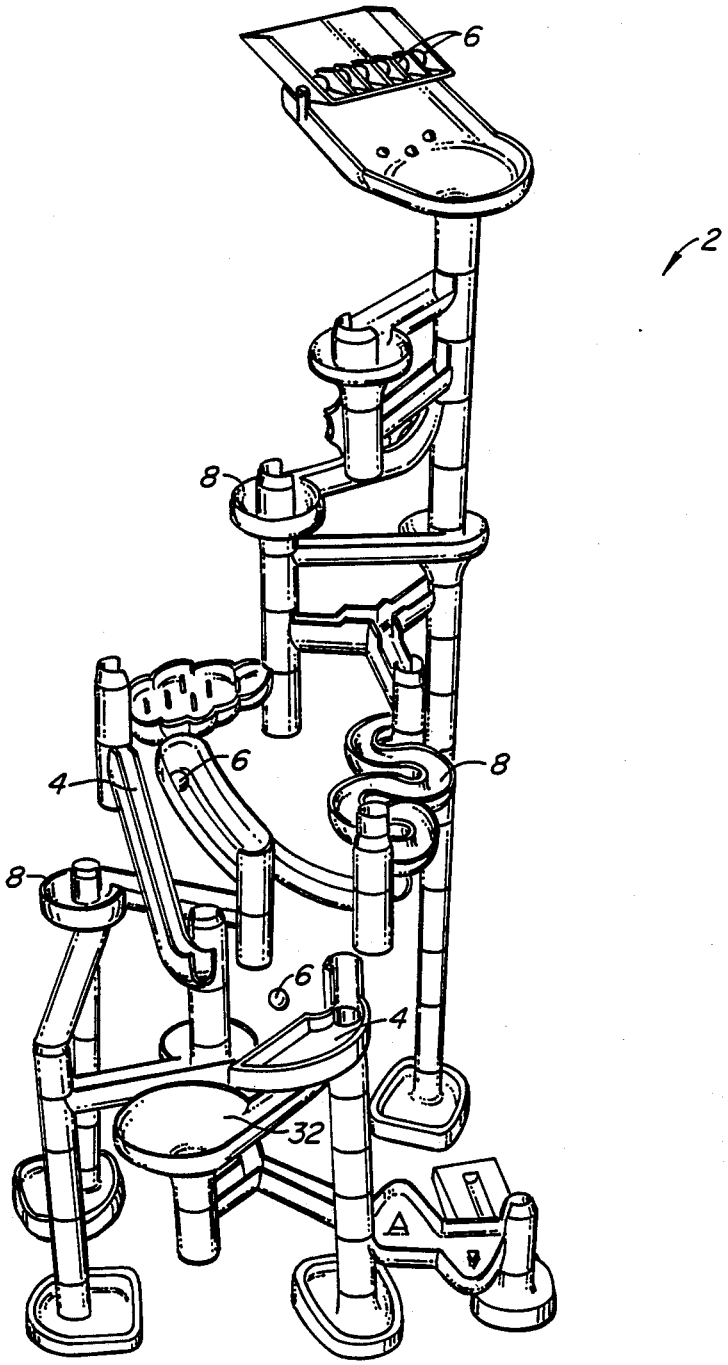
FIG. 1 is an overall perspective view of a marble race game including the marble race toy of the present invention.
Figure 2:
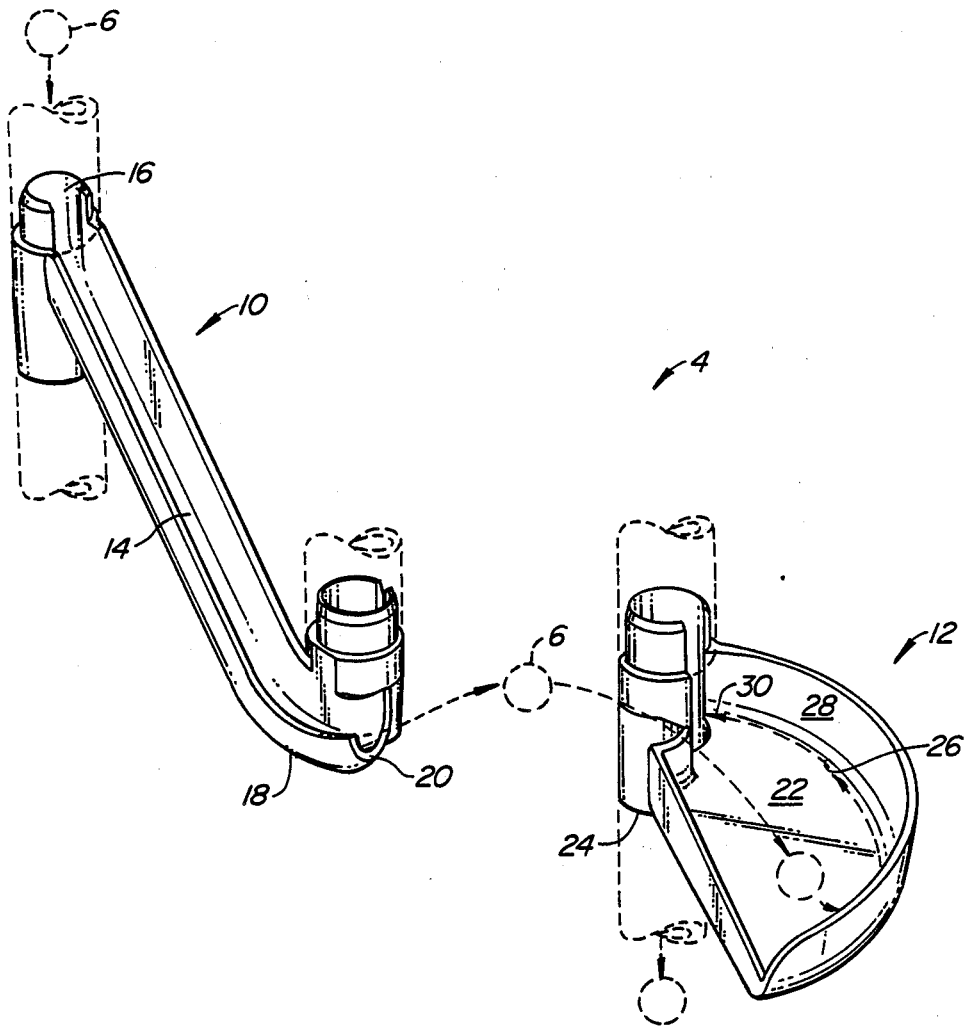
FIG. 2 is a perspective view of the marble race toy of the present invention, the path of the marble shown in dashed lines.
Figure 3:
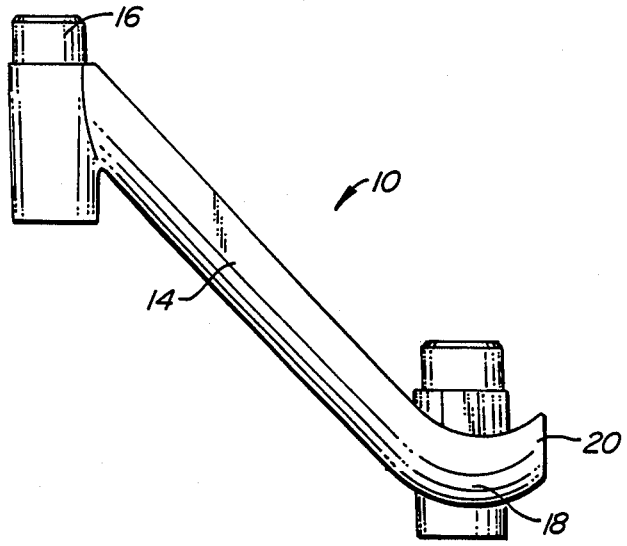
FIG. 3 is a side view of the chute of the marble race toy of FIG. 2.
Figure 4:
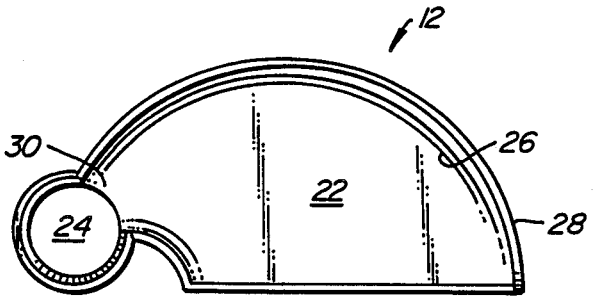
FIG. 4 is a top view of the landing of the marble race toy of FIG. 2.

Referring now to the drawings, FIG. 1 illustrates the marble race game 2 constructed to include a marble race toy 4 intermediate the ends of the tortuous path in which marble 6 travels. For ease of reference, a marble, as herein defined, is considered any object which is capable of rolling along the tortuous path of the game, and, therefore, could be generally cylindrical or generally oval, as well as spherical.

The arrangement of the various toys 8 constituting game 2 may be varied from that disclosed in FIG. 1. The toys other than marble race toy 4 are shown for environmental purposes only and do not constitute a part of this invention. They will, therefore, not be described in detail in this application.

Referring now also to FIGS. 2-5, marble race toy 4 includes J-shaped chute 10 and landing 12 spaced from the chute. Downwardly extending track 14 has a generally U-shaped cross section sized to accommodate rolling marbles 6. Track 14 couples an entrance 16 with a jump 18 created at the upturned end 20 of chute 10.

Figure 5:
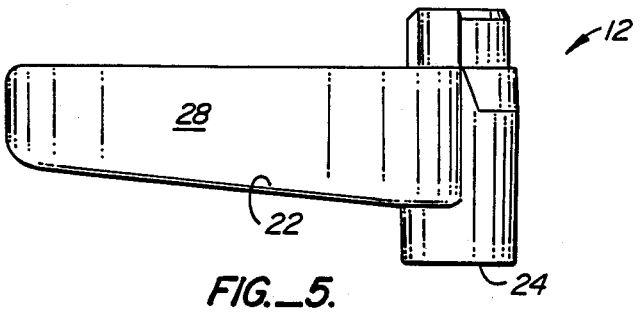
FIG. 5 is a back side view of the landing of the marble race toy of FIG. 2.

Landing 12 includes landing surface 22 and exit 24 located at one side of landing 12. Landing surface 22 includes a flat surface having a generally semi-circular shape and arcuate boundary 26. A back stop 28 extends vertically from arcuate boundary 26. Arcuate boundary 26 includes a terminal end 30 at exit 24. Landing surface 22 slopes downwardly toward exit 24, as shown in FIG. 5.

Chute 10 and landing 12 constitute two separate elements to be arranged within the construction of marble race game 2. Chute 10 and landing 12 are spaced from each other such that marble 6 travels through upturned end 20 and lands on surface 22. The landing surface is preferably positioned above the height at which marble 6 begins its trajectory in order to ensure that the marble does not continue its trajectory past landing 12, and out of game 2.

In use, marble 6 rolls through various toys 8 of marble race game 2. As marble 6 enters marble race toy 4 through entrance 16 positioned at the top of chute 10, the marble increases its speed as it rolls through downwardly extending speed track 14 and then into upturned end 20 of jump 18 to begin its trajectory through the space between chute 10 and landing 12. Marble 6 impacts landing surface 22 and continues its forward trajectory until it reaches back stop 28. The path of marble 6 is redirected along arcuate boundary 26 to terminal end 30 and through exit 24. The path of marble 6 as it begins its trajectory from upturned end 20, onto landing surface 22, arcuate boundary 26 and through exit 24 is shown in dashed lines in FIG. 2.

Although landing 12 has been particularly described as a generally semi-circular toy, the shape of the landing surface and arcuate boundary may be configured in a variety of ways. Similarly, upturned end 20 could be configured in a variety of ways to change the trajectory as marble 6 hurdles the space between chute 10 and landing 12. In addition, an alternate toy, such as a funnel toy 32 as seen in FIG. 1, could be positioned in place of landing 12 to alter the tortuous path of marble 6 after it clears the space between chute 10 and landing 12.

Modification and variation can be made to the disclosed embodiment without departing from the subject matter of the invention as defined by the following claims

I claim:

1. A toy for use with a marble race game in which the marble moves along a tortuous path comprising:

a chute having an entrance, a jump, and a downwardly extending speed track connecting the entrance and the jump;

a landing spaced from the jump and having a planar surface substantially larger than the width of the marble, an arcuate boundary projecting upwardly from said planar surface, and an exit positioned at a terminal end of said arcuate boundary and said planar surface; and the chute configured and the landing positioned so that a marble enters the chute through the entrance, travels down the speed track, into the jump, out of the chute in a trajectory, lands at the landing and passes through the exit for traverse of the marble through the game.

2. The toy as defined in claim 1 wherein the jump includes an upturned end.

3. The toy as defined in claim 1 wherein the landing comprises an arcuate boundary having a terminal end, and wherein the exit is positioned at the terminal end.

4. The toy as defined in claim 1 wherein the landing includes a backstop for altering the path of the marble.

5. The toy as defined in claim 1 wherein the landing includes a landing surface sloping downwardly toward the exit.

6. A toy for use with a marble race game in which the marble moves along a tortuous path comprising:

a J-shaped chute havin an entrance, a jump having an upturned end, and a downwardly sloping speed track coupling the entrance and the jump;

a landing spaced from the jump, having a planar surface substantially larger than the width of the marble, an arcuate boundary projecting upwardly from said planar surface, and an exit positioned at a terminal end of the arcuate boundary and said planar surface; and the chute configured and the landing positioned so that a marble enters the chute through the entrance, travels down the speed track into the jump, out of the chute, lands at the landing, travels along the arcuate boundary to the terminal end and through the exit for traverse of the marble through the game.

7. The toy as defined in claim 6 wherein the landing includes a landing surface sloping downwardly toward the exit.

8. The toy as defined in claim 1 wherein the planar surface is configured such that the marble freely rolls on said planar surface.

* * * * *